US007475016B2

(12) United States Patent
Smith et al.

(10) Patent No.: US 7,475,016 B2
(45) Date of Patent: Jan. 6, 2009

(54) SPEECH SEGMENT CLUSTERING AND RANKING

(75) Inventors: Maria E. Smith, Davie, FL (US); Jie Z. Zeng, Miami, FL (US)

(73) Assignee: International Business Machines Corporation, Armonk, NY (US)

( * ) Notice: Subject to any disclaimer, the term of this patent is extended or adjusted under 35 U.S.C. 154(b) by 733 days.

(21) Appl. No.: 11/012,622

(22) Filed: Dec. 15, 2004

(65) Prior Publication Data

US 2006/0129401 A1 Jun. 15, 2006

(51) Int. Cl.
*G10L 13/00* (2006.01)

(52) U.S. Cl. ..... 704/258; 704/260; 704/255; 704/249; 704/10

(58) Field of Classification Search ..... 704/261, 704/231, 258, 259, 263, 245
See application file for complete search history.

(56) References Cited

U.S. PATENT DOCUMENTS 4,092,493 A 5/1978 Rabiner et al.
5,963,903 A 10/1999 Hon et al.
6,178,401 B1 1/2001 Franz et al.
6,188,982 B1 2/2001 Chiang
6,226,637 B1 * 5/2001 Carey et al. ..... 707/4
6,493,667 B1 12/2002 de Souza et al.
6,665,641 B1 * 12/2003 Coorman et al. ..... 704/260
7,165,030 B2 * 1/2007 Yi et al. ..... 704/238
7,191,132 B2 * 3/2007 Brittan et al. ..... 704/260
7,219,060 B2 * 5/2007 Coorman et al. ..... 704/258
2002/0128836 A1 9/2002 Konuma et al.
2003/0110031 A1 6/2003 Menendez-Pidal et al.

OTHER PUBLICATIONS

U.S. Appl. No. 10/630,113, Gleason et al.

* cited by examiner

*Primary Examiner*—Vijay B Chawan
*Assistant Examiner*—Matthew Baker
(74) *Attorney, Agent, or Firm*—Akerman Senterfitt

(57) ABSTRACT

A system, method, and apparatus for identifying problematic speech segments is provided. The system includes a clustering module for generating a first cluster of one or more consecutive speech segments if the consecutive speech segments satisfy a predetermined filtering test, and for generating a second cluster comprising at least one different consecutive speech segment selected from the ordered sequence if the at least one different consecutive speech segment satisfies the predetermined filtering test. The system also includes a combining module for combining the first and second clusters as well as the at least one intervening consecutive speech segment to form an aggregated cluster if the aggregated cluster satisfies a predetermined combining criterion. The system can further include a ranking module for ranking aggregated clusters, the ranking reflecting a relative severity of misalignments among problematic speech segments. Once identified, more severely misaligned speech segments can be analyzed more effectively and efficiently.

21 Claims, 6 Drawing Sheets

SPEECH SEGMENT CLUSTERING AND RANKING

BACKGROUND

1. Field of the Invention

The present invention is related to the field of electronic speech processing, and, more particularly, synthetic speech generation.

2. Description of the Related Art

Synthetic speech can be generated using various techniques. For example, one well-established technique for generating synthetic speech is a data-driven approach which, based on a textual guide, splices samples of actual human speech together to form a desired text-to-speech (TTS) output. This splicing technique for generating TTS output is sometimes referred to as a concatenative text-to-speech (CTTS) technique.

CTTS techniques require a set of phonetic units, called a CTTS voice, that can be spliced together to form CTTS output. A phonetic unit can be any defined speech segment, such as a phoneme, an allophone, and/or a sub-phoneme. Each CTTS voice has acoustic characteristics of a particular human speaker from which the CTTS voice was generated. A CTTS application can include multiple CTTS voices to produce different sounding CTTS output. That is, each CTTS voice is language specific and can generate output simulating a single speaker so that if different speaking voices are desired, different CTTS voices are necessary.

A large sample of human speech called a CTTS speech corpus can be used to derive the phonetic units that form a CTTS voice. Due to the large quantity of phonetic units involved, automatic methods are typically employed to segment the CTTS speech corpus into a multitude of labeled phonetic units. Each phonetic unit is verified and stored within a phonetic unit data store. A build of the phonetic data store can result in the CTTS voice.

Unfortunately, the automatic extraction methods used to segment the CTTS speech corpus into phonetic units can occasionally result in errors due to misaligned phonetic units. A misaligned phonetic unit is a labeled phonetic unit containing significant inaccuracies. Common misalignments include the mislabeling of a phonetic unit and improper boundary establishment for a phonetic unit. Mislabeling occurs when the identifier or label associated with a phonetic unit is erroneously assigned. For example, if a phonetic unit for an "M" sound is labeled as a phonetic unit for "N" sound, then the phonetic unit is a mislabeled phonetic unit. Improper boundary establishment occurs when a phonetic unit has not been properly segmented so that its duration, starting point and/or ending point is erroneously determined.

Since a CTTS voice constructed from misaligned phonetic units can result in low quality synthesized speech, it is desirable to exclude misaligned phonetic units from a final CTTS voice build. Unfortunately, manually detecting misaligned units is typically unfeasible due to the time and effort involved in such an undertaking. Conventionally, technicians remove misaligned units when synthesized speech output produced during CTTS voice tests contains errors. That is, the technicians attempt to "test out" misaligned phonetic units, a process that can correct the most grievous errors contained within a CTTS voice builder. There remains, however, a need for more efficient, more rapid techniques for performing such "voice cleanings," both with respect to CTTS voices and other synthetically generated voices based upon a phonetic data store.

SUMMARY OF THE INVENTION

The present invention provides an effective and efficient method, system, and apparatus for handling potentially misaligned speech segments within an ordered sequence of speech segments. The invention reflects the inventors' recognition that in the practice of creating a voice such as CTTS voice, whereby phonetic alignments are automatically generated, misalignments are seldom encountered in isolation. Instead, when a sequence of one or more speech segments is found that is misaligned, there is frequently a significant probability that surrounding segments are likewise misaligned. This likelihood is greater the more severely misaligned the initially identified sequence is found to be.

A result of this phenomenon, as has been recognized by the inventors, is that the more severely misaligned a speech segment is, the more likely it is that the speech segment is part of a cluster of misaligned speech segment. As has been further recognized by the inventors, if speech segments are clustered on the basis of an index reflecting their individual probabilities of misalignment, then it follows that the size of cluster can be combined with indexing to obtain a better measure of the likelihood that a sequence of speech segments is misaligned.

A method according to one embodiment of the present can include identifying one or more clusters of potentially misaligned speech segments that may lie within a sequence of speech segments arranged in an ordered sequence. A speech segment from the ordered sequence is included in a cluster if and only if the speech segment satisfies a predetermined filter text. Each cluster, moreover, is bordered by at least one other speech segment from among the plurality of sequentially arranged speech segments, the at least one other speech segment failing to satisfy the predetermined filtering test. Accordingly, any two clusters that may be found to lie within the ordered sequence of speech segments will be separated by at least one intervening speech segment that does not satisfy the filtering test.

The method further can include forming an aggregated cluster from two or more clusters whenever at least two clusters are identified. An aggregated cluster can be generated by combining the respective speech segments of the at least two clusters with one another, as well as with the one or more intervening speech segments between the two clusters if the aggregated cluster satisfies a predetermined combining criterion.

A system according to another embodiment of the present invention can include a clustering module. The clustering module can generate a first cluster comprising one or more consecutive speech segments selected from the ordered sequence if the consecutive speech segments satisfy a predetermined filtering test. The clustering module can also generate a second cluster comprising at least one different consecutive speech segment selected from the ordered sequence if the at least one different consecutive speech segment satisfies the predetermined filtering test. If both are generated, the second cluster is distinct from the first cluster and at least one intervening consecutive speech segment belonging to the ordered sequence occupies a sequential position between the speech segments of the respective clusters. The system also can include a combining module for combining the first and second clusters along with the at least one intervening consecutive speech segment to form an aggregated cluster if the aggregated cluster satisfies a predetermined combining criterion.

An apparatus according to yet another embodiment of the invention can comprise computer-readable storage medium for use in creating clusters of speech segments from an ordered sequence of speech segments. The computer-readable storage medium can contain computer instructions for generating one or more clusters comprising consecutive speech segments that satisfy a predetermined filtering test. If more than one cluster is generated according to the instructions, then at least one intervening consecutive speech segment belonging to the ordered sequence occupies a sequential position between the respective speech segments of the pair of clusters so generated. The computer-readable storage medium also can include one or more computer instructions for combining the first and second clusters and the at least one intervening consecutive speech segment to generate an aggregated cluster if the aggregated cluster satisfies a predetermined combining criterion.

BRIEF DESCRIPTION OF THE DRAWINGS

There are shown in the drawings, embodiments which are presently preferred, it being understood, however, that the invention is not limited to the precise arrangements and instrumentalities shown.

DETAILED DESCRIPTION OF THE INVENTION

Figure 1:
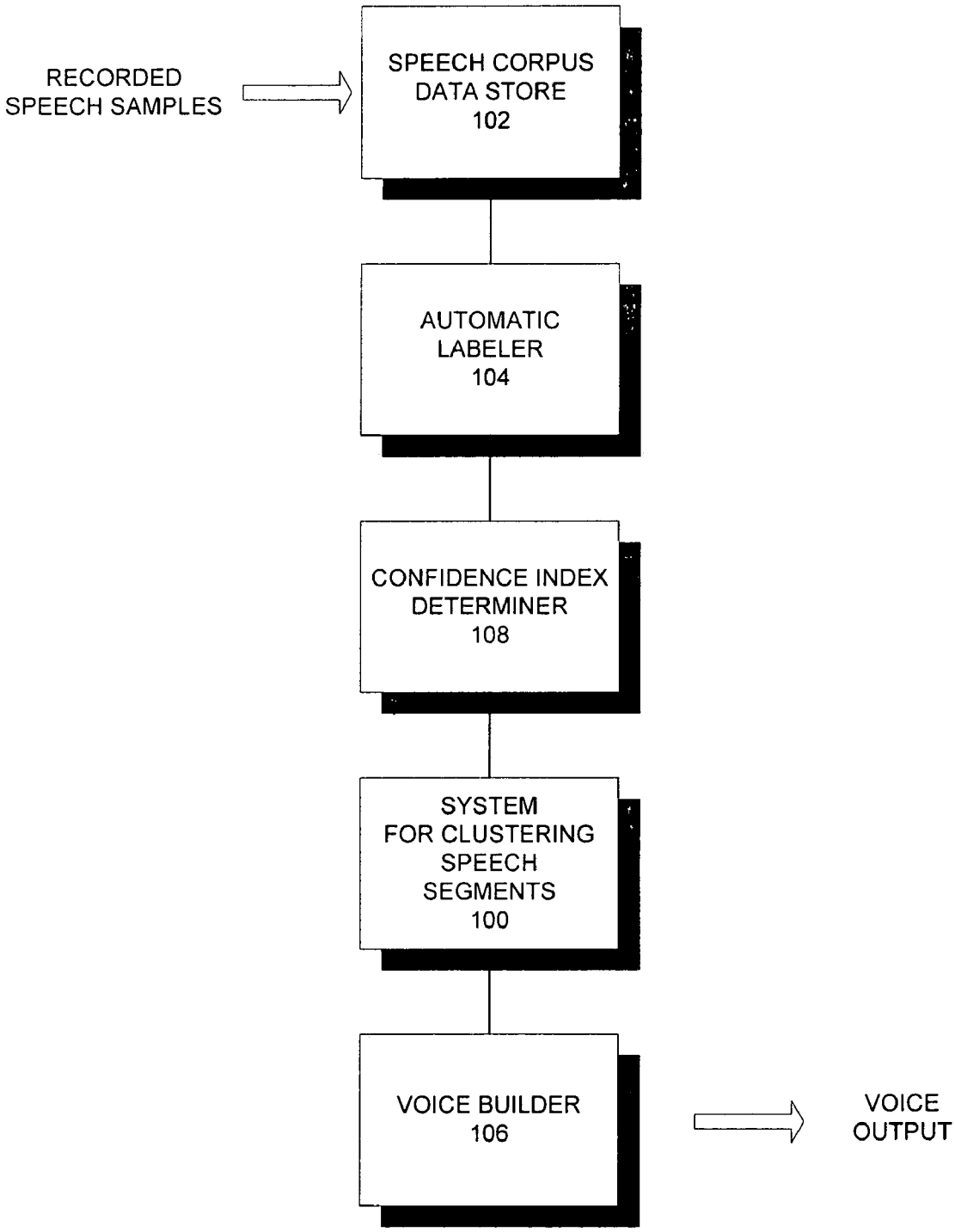
FIG. 1 is a schematic diagram of various components with which a system according to one embodiment of the present invention can advantageously be utilized.

FIG. 1 is a schematic diagram of interconnected voice creation components, including a system 100 for identifying misaligned speech segments according to one embodiment of the present invention. The components illustratively generate synthesized speech by splicing together speech segments derived from samples of recorded human speech. For example, the components can be used by a voice developer or technician to create a voice output, such as a CTTS voice, by splicing together speech segments that define phonetic units derived from recorded human speech samples. The speech segments defining these phonetic units include phonemes, allophones, and sub-phonemes.

The system 100 operates cooperatively with the other components shown in FIG. 1 so as to enable the voice developer to more rapidly and efficiently create a voice output, such as a CTTS voice. It will be evident from the discussion herein, that the system 100 can be employed with a wide range of data-driven voice generation techniques and that CTTS voice generation is but one type of speech generation with which the system can be used advantageously.

The components in FIG. 1 illustratively include a speech corpus 102 comprising a data store of sampled speech. The speech corpus 102 illustratively connects with and supplies speech samples to an automatic labeler 104. The automatic labeler 104 automatically segments the speech samples into phonetic units or speech segments, appropriately labeling each. For example, a particular phonetic unit or speech segment can be labeled as a specific allophone or phoneme extracted from a particular speech sample. In one embodiment, the automatic labeler 104 can utilize linguistic context of neighboring speech segments to improve accuracy.

As one of ordinary skill will readily appreciate, a variety of speech processing techniques can be used by the automatic labeler 104. In accordance with one embodiment, the automatic labeler 104 can detect silences between words within a speech sample supplied from the speech corpus 102. The automatic labeler 104 separates the sample into a plurality of words and subsequently uses pitch excitations to segment each word into phonetic units or speech segments. Each speech segment can then be matched by the automatic labeler 104 to a corresponding phonetic unit contained with a stored repository of model phonetic units. Thereafter, each phonetic unit or speech segment can be assigned a label by the automatic labeler 104, the label relating the speech segment with the matched model phonetic unit. Neighboring phonetic units can be appropriately labeled and used to determine the linguistic context of a selected phonetic unit. This description is merely exemplary, and it is to be understood that the automatic labeler 104 is not limited to any particular methodology or technique. A variety of different techniques can be employed by the automatic labeler 104. For example, the automatic labeler 104, alternately, can segment received speech samples into phonetic units or speech segments based upon glottal closure instance (GCI) detection.

The components in FIG. 1 also illustratively include a voice builder 106 that can be used by a voice developer for creating output, such as a CTTS voice referred to above. The voice builder 106 receives phonetic units or speech segments and, based on the received input, builds a voice such as a CTTS voice. The voice builder 106 can comprise hardware and/or software components (not shown) that are appropriately configured to enable the voice developer to create the voice according to a predefined set of criteria.

During the process effected by the cooperative interaction of the voice builder 106 with the automatic labeler 104 and the speech corpus 102, misalignments can occur. Misalignments can include mislabeling a phonetic unit or speech segment and establishing erroneous boundaries for a phonetic unit or speech segment. Accordingly, the illustrative components in FIG. 1 further include a confidence index determiner 108 for determining confidence indexes for the speech segments, each index indicating a potential that a corresponding speech segment is misaligned.

Illustratively, the confidence index determiner 108 is interposed between the automatic labeler 104 and the voice builder 106. The confidence index determiner 108 can include hardware and/or software components configured to analyze unfiltered phonetic units to determine a likelihood that the phonetic units contain one or more misalignments. According to one embodiment, the confidence index determiner 108 assigns an index to each phonetic unit, the index being based upon the detection of possible misalignments or a lack thereof.

A particular type of index assignable by the confidence index determiner 108 is a confidence index that reflects the likelihood that a speech segment is misaligned or not. The confidence index can comprise a score or value derived from a comparison of the speech signal to one or more of various predefined models. It will be apparent to one skilled in the art that the confidence index can be expressed in any of a variety of formats or conventions. In one embodiment, the confidence index can be expressed as a normalized value.

In the context of a CTTS voice generation, the confidence index determiner 108 can be utilized for effecting a CTTS voice cleaning process. Such cleaning processes, generally, are used to generate verified speech segments. The verified speech segments illustratively make up a preferred set of phonetic units or speech segments that the voice builder 106 can choose from in order to generate synthetic speech output, such as a CTTS voice. The preferred set of speech segments comprise those for which there is some minimal confidence of the segments being free of misalignment.

Based upon a particular indexing, ranking, or other indication of relative confidence, the speech segments can be filtered based upon a predetermined criteria. Those speech segments that, at least minimally, satisfy the predetermined criteria can be filtered out and supplied directly to the voice builder 106. Those speech segments that fail to satisfy the criteria are identified for further treatment by a voice developer. Filtering enables a voice developer to more quickly focus on problematic speech segments.

To enhance efficiency in dealing with problematic speech segments, the system 100 is interposed between the confidence index determiner 108 and the voice builder 106. The system 100 is founded on two observations that are reflected in how the system deals with problematic speech segments. The first is that automatically generated phonetic alignment of speech samples are relatively less likely to contain misalignments in isolation. That is, when a speech segment is severely misaligned, neighboring speech segments are accordingly more likely to also be misaligned. It follows that misaligned speech segments, especially severely misaligned speech segments, are relatively more likely to be part of a cluster of misaligned speech segments. Various techniques optionally implemented by the system 100 for measuring relative likelihoods are discussed in more detail below.

The second observation on which the system 100 is founded is that a voice developer is often likely to analyze problematic speech segments jointly rather than in isolation. For example, a voice developer examining a waveform or a spectrogram corresponding to a problematic speech segment is likely to do so while simultaneously viewing waveforms or spectrograms corresponding to portions of adjacent speech segments. Accordingly, the system 100 operates as a clustering system, one that clusters problematic speech segments according to a predefined criterion so that they can be handled jointly rather than in isolation.

Figure 2:
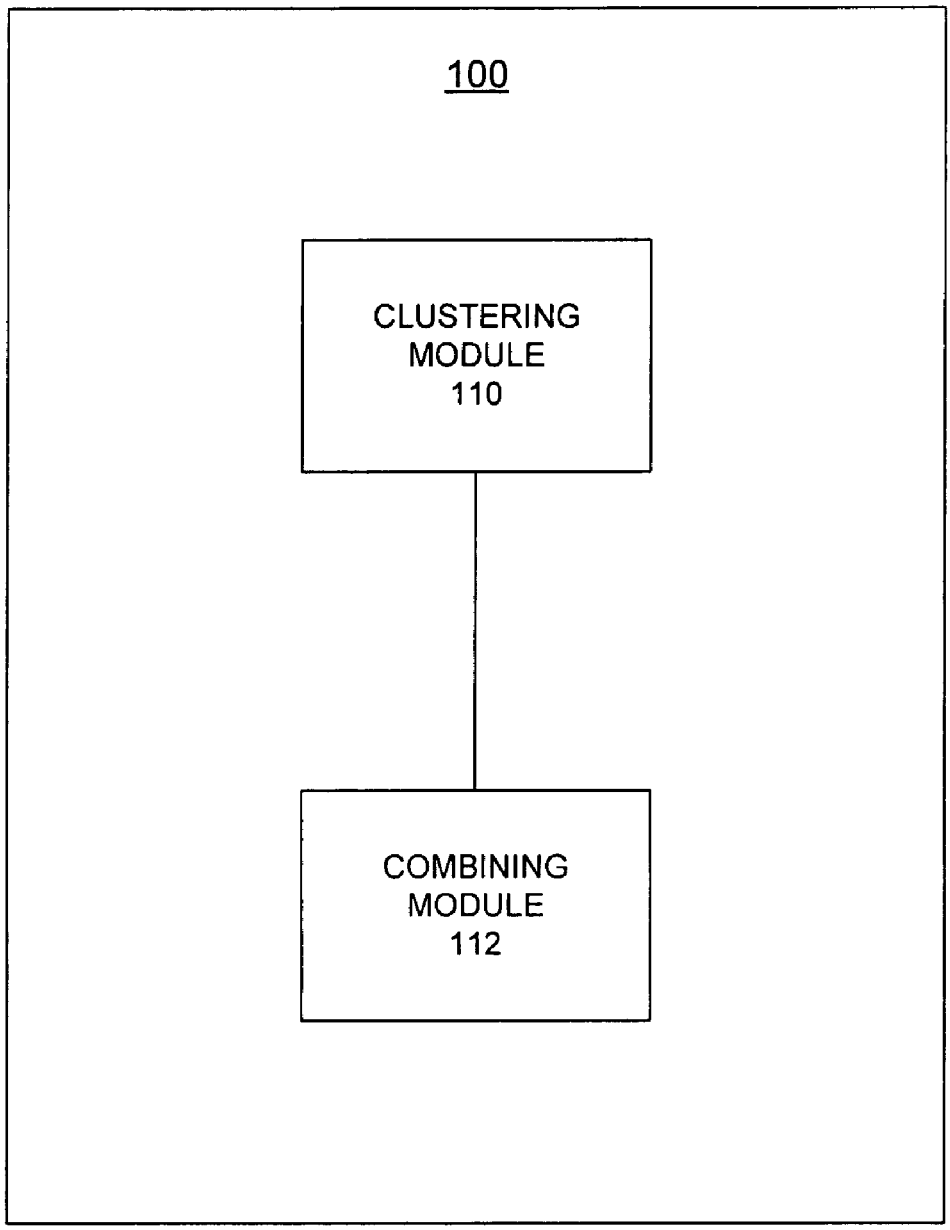
FIG. 2 is a schematic diagram of a system according to one embodiment of the present invention.

FIG. 2 provides a more detailed schematic diagram of the system 100. The system 100 illustratively includes a clustering module 110 and a combining module 112 communicatively linked to the clustering module. The clustering module is configured to operate on any ordered sequence of speech segments. An example of such an order sequence is provided in Table 1.

TABLE 1

| Sequence Number | Confidence Index (CI) |
|---|---|
| 1 | −10 |
| 2 | −25 |
| 3 | 5 |
| 4 | 10 |
| 5 | −44 |
| 6 | −21 |
| 7 | −22 |
| 8 | 40 |
| 9 | 60 |
| 10 | 20 |

The ordered sequence of speech segments in Table 1 illustratively comprises segments that already have been processed by the automatic labeler 104 and passed to the confidence index determiner 108. As indicated in Table 1, each of the speech segments in the ordered sequence also has been indexed by the confidence index determiner 108 according to one or more of the various criteria described above. The resulting indexes corresponding to each of the illustrated speech segments is given in the right hand-hand column in Table 1.

For any ordered sequence of speech segments, the clustering module 110 identifies one or more clusters of potentially misaligned speech segments. To do so, the clustering module 110 looks at each of the speech segments of the ordered sequence, sequentially examining each. If one speech segment satisfies the filtering test, in the sense of being identified as a potentially misaligned or problematic speech segment, a first cluster is identified. If the next speech segment also satisfies the filtering test, it is identified with the first cluster. Otherwise, the clustering module 110 continues the sequential examination until another potentially misaligned speech segment is encountered, in which event a second cluster is identified, or until all of the remaining speech segments have been examined and found not to be problematic. Accordingly, none or any number of clusters can be identified by the clustering module 110 depending both on the number of potentially misaligned speech segments found within the ordered sequence and whether there are one or more intervening speech segments in the ordered sequence not identified as potentially misaligned and lying between any pair of clusters of potentially misaligned speech segments.

Each of the clusters thus identified by the clustering module 110 can be characterized as including one or more speech segments, but including a particular speech segment if and only if that speech segment satisfies the filtering test. Moreover, each cluster, if any exist in the ordered sequence, is bordered by at least one other speech segment in the ordered sequence that is not identified as a potentially misaligned speech segment. Thus, another characteristic of the clusters identified by the clustering module 110 is that any pair of clusters so identified are separated by one or more speech segments in the ordered sequence that are not identified as potentially misaligned speech segments.

Note, in the sense used herein, a speech segment that satisfies the filtering test is deemed to be problematic. Those that do not satisfy the test are thus, again, "filtered out." As with the confidence index, the filtering test can be based on any of a variety of criteria, such as the ones described below. To illustrate, the operation of the clustering module 110, the procedure is illustratively applied to the ordered sequence of speech segments in Table 1, the applicable filtering test being based on the corresponding confidence indices given in the table. Each confidence index illustratively reflects a likelihood that the corresponding speech segment is misaligned, a higher number indicating a greater likelihood that the corresponding speech segment is not misaligned. The filtering test is illustratively deemed to hinge on whether a speech segment has a corresponding index that is at least zero. Otherwise, the speech segment is deemed to be problematic. Under this criteria, a first cluster comprises the first and second speech segments. That is, the filtering test is satisfied with respect to speech segments 1 and 2.

The next speech segment of the ordered sequence that, according to the stated criteria, can be deemed problematic is the fifth speech segment. The sixth and seventh speech segments are similarly deemed problematic according to the stated criteria, since each of the these speech segments has a corresponding confidence index less than zero. Accordingly, the clustering module 110 also generates a second cluster comprising at least one different consecutive speech segment selected from the ordered sequence. Since speech segments 5, 6, and 7 satisfy the filtering test, they comprise the different consecutive speech segments contained in the second cluster generated by the clustering module 110. Note that the second cluster is distinct from the first cluster. Moreover, as is the case generally with distinct clusters generated by the clustering module 110, there is at least one intervening consecutive speech segment belonging to the ordered sequence that occupies a sequential position between the at least one speech segment and the at least one different consecutive speech segment making up, respectively, two different clusters. The intervening speech segments, in particular, are segments 3 and 4 of the ordered sequence in Table 1.

Generalizing from the above example, the clustering module 110 operates on any ordered sequence of speech segments as follows. First, the clustering module 110 generates a first cluster comprising at least one consecutive speech segment selected from the ordered sequence if the at least one consecutive speech segment satisfies a predetermined filtering test. Second, the cluster module generates a second cluster comprising at least one different consecutive speech segment selected from the ordered sequence if the at least one different consecutive speech segment satisfies the predetermined filtering test, the second cluster being distinct from the first cluster. Additional clusters are formed according to the same procedure until the entire ordered sequence has been processed according to the operative criteria of the clustering module 110. Note, again, that at least one intervening consecutive speech segment belonging to the ordered sequence occupies a sequential position between each pair of clusters generated by the clustering module 110.

As noted above, it is frequently more likely that misaligned speech segments will be found together rather than in isolation. In the context of the current example, for instance, segments 1 and 2 of the first cluster are relatively close to segments 5, 6, and 7 of the second cluster, separated as they are by only two intervening speech segments in the ordered sequence of Table 1. Thus, there is at least some probability that the intervening segments are also misaligned, in which event, it may be better for a voice developer to treat all of the first seven speech segments as problematic. These probabilities provide the motivation for illustratively including the combining module 112 in the system 100. The combining module 112 provides a basis for combining the first and second clusters and the at least one intervening consecutive speech segment so as to generate an aggregated cluster if the aggregated cluster satisfies a predetermined combining criterion. When formed, the aggregated cluster replaces the first and second clusters. Thus, by combining clusters, the combining module 112 generates a cluster of clusters.

The are various functional forms that the combining criterion can take, each of which can be implemented by the combining module 112. All of the combining criterion, by design, reflect various criteria for judging the likelihood that the speech segments of two distinct clusters generated by the clustering module 110, as well as the one or more intervening speech segments, constitute a single aggregated cluster of likely misaligned speech segments. According to one embodiment, the combining criterion is based on the number of intervening speech segments positioned in the ordered sequence between the speech segments of two clusters. In general, the fewer the number of intervening speech segments, the more likely that all the speech segments constitute an aggregated cluster of problematic speech segments. Accordingly, in one form, the combining criterion sets a threshold for the number of intervening speech segments, the threshold termed a breaking condition. If this threshold is exceeded, two clusters that bracket the intervening speech segments are not aggregated together with the intervening speech segments, but instead are left "broken up" into distinct clusters.

According to another embodiment, the combining criterion implemented by the combing module 112 is based upon the number of speech segments contained in an aggregated cluster. This form is based on a threshold characterized as the sizing condition. It requires that the number of speech segments contained in the aggregated cluster be greater than a predetermined number. In yet another embodiment, the combining criterion is based upon the corresponding confidence indexes of the speech segments contained in distinct clusters. This form of the combining criteria, designated as the confidence sum condition, aggregates clusters based on whether the sum of their corresponding confidence indexes is less than a predetermined threshold. According to still another embodiment, the combining criterion can be based on a predetermined function of the various confidence indexes. For example, one functional form of the combining criterion also based on confidence indexes requires that an aggregated cluster be formed from distinct clusters only if doing so minimizes a sum of confidence indexes. Still other forms of the functional test can be similarly implemented by the combining module 112.

More generally, by appropriately defining the combining criteria implemented by the combining module 112, a voice developer can control which attributes are used for clustering speech segments and aggregating clusters. These attributes, as will be readily understood by one of ordinary skill in the art, include Viterbi log probabilities, pitch marks, durations, energy levels, and other such attributes that characterize individual speech segments. By specifying the combining criterion, the voice developer is able to control which attributes are used, and in what form, to identify misalignment problems during the generation of a voice, such as a CTTS voice.

Figure 3:
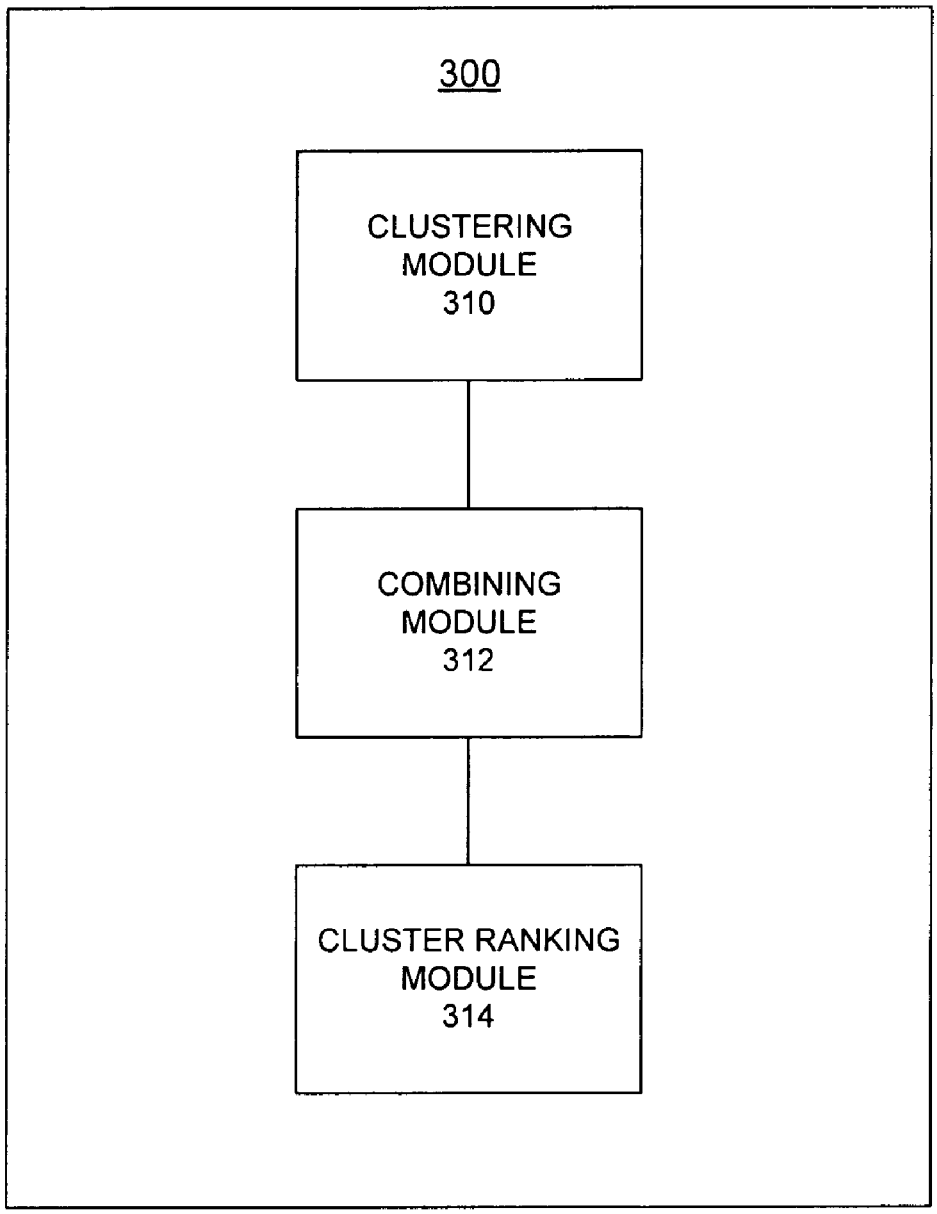
FIG. 3 is a schematic diagram of a system according to another embodiment of the present invention.

FIG. 3 provides a schematic diagram of still another embodiment of the system according to present invention. The system 300, in addition to a clustering module 310 and combining module 312 includes a cluster ranking module 314. The cluster ranking module 314 assigns a cluster ranking to each cluster and/or aggregated cluster generated by the system 300. Once ranked, the clusters and/or aggregated clusters generated can be sorted based upon the particular ranking. This enables a voice developer to focus on those clusters and/or aggregated clusters deemed to be most problematic.

Various ranking schemes can be implemented by the cluster ranking module 314. According to one embodiment, the ranking scheme is based upon the size of the cluster and/or aggregated cluster as well as the corresponding confidence indexes of the speech segments that comprise each. More particularly, the following cluster confidence index (CCI) is computed for each cluster:

$$CCI=(W_s*S)(W_c*C_{min}),$$

where $W_s$=a weighting factor of the size of the ranking cluster; $W_c$=a weighting factor of the minimum confidence index corresponding to the cluster; S=size of the cluster; and $C_{min}$=a minimum confidence index of the elements within the ranking cluster. According to still another embodiment, the ranking scheme is based upon the sum of the corresponding indexes:

$$CCI = \sum_{i}^{n} C_i,$$

where CCI=the cluster confidence index, and n is the number of speech segments of the underlying ordered sequence of speech segments.

According to another embodiment, the ranking module 314 is operatively linked with a memory device in which one or more records are stored, each record comprising a memory address location and corresponding cluster confidence index. The records are sorted based on the cluster confidence indexes so that the lower the cluster confidence index, the higher the score assigned to the cluster.

Figure 4:
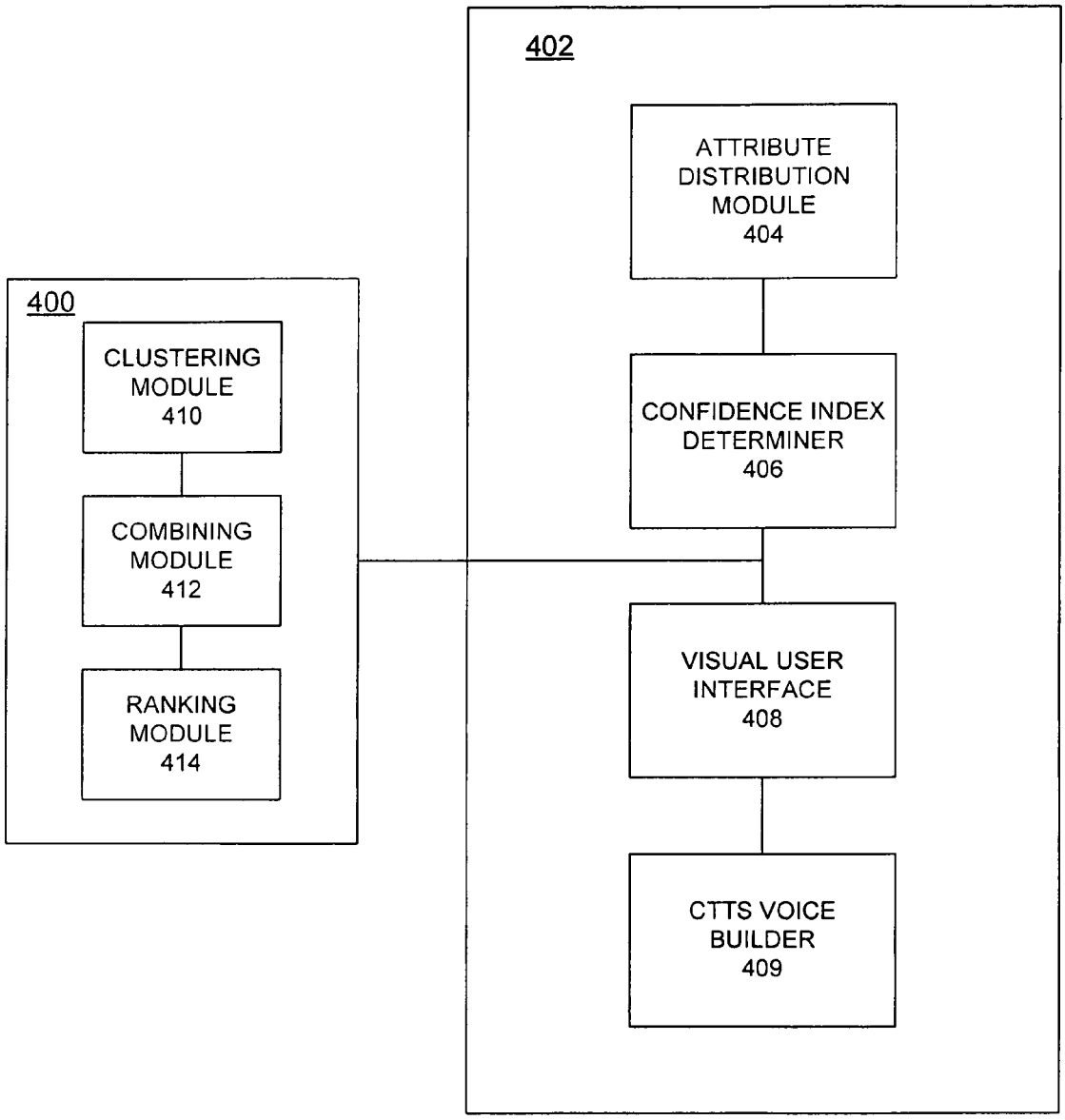
FIG. 4 is a schematic diagram of various components for creating a CTTS voice using a system according to yet another embodiment of the present invention.

FIG. 4 illustrates yet another embodiment, according to which the system 400 is communicatively linked with or integrated into a computing device 402 that provides a user with various capabilities for effecting a CTTS voice cleaning. The system 400, again, includes a clustering module 410, a combining module 412 connected with the clustering module, and a ranking module 414 connected with the combining module for ranking clusters and/or aggregated clusters generated as described above. The computing device 402 illustratively comprises a plurality of modules, including an attribute distribution module 404, a confidence index determiner 406, a visual user interface 408, and a CTTS voice builder 409 connected with one another.

The attribute distribution module 404 is configured to calculate distributions of the attributes of various phones and sub-phones. The distributions can be displayed by the visual user interface 408. Based upon the display, the CTTS voice developer decides on a desirable set of parameter for analyzing and cleaning the CTTS voice. Based upon the desired parameters, the confidence index determiner 406 identifies suspected misalignments and assigns confidence indexes to the underlying speech segments, as already described.

The CTTS voice developer further specifies the filtering test and combining criteria that are used by the system 400 to cluster the speech segments, combine clusters, and rank any of the clusters and/or aggregated clusters generated, as also described above. A final ranking result is saved to a file or the CTTS voice developer provides an external ranking. The visual user interface 408 then displays the results saved in the file. A waveform or spectrogram corresponding to each ranked cluster is also displayed along with the attributes of the underlying speech segments by the visual user interface 408. Based upon the rankings, the CTTS voice developer can select all, some, or none of the ranked clusters. Using tools provided by the CTTS voice builder 410, the developer then can correct the underlying speech segments of any clusters selected, or, alternately, can mark an incorrect speech segment for omission from the voice being created. This procedure can be repeated as often as needed to effect one of two outcomes, either the misalignment severities are minor and stable, or all misalignments have been corrected. What is important is that the CTTS voice developer is able to complete a voice cleaning process efficiently and in a relatively short time frame by correcting only the most severe misalignment problems while still delivering a CTTS voice of reasonably good quality.

Figure 5:
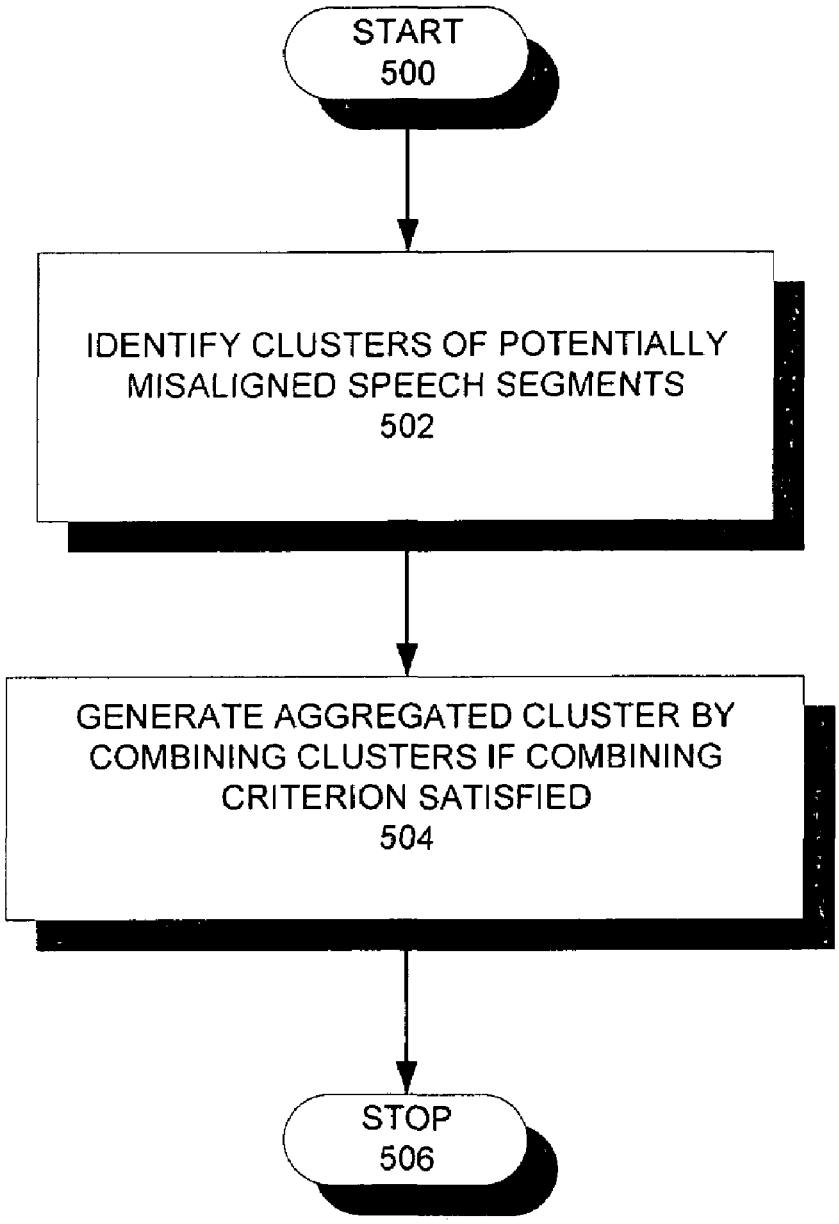
FIG. 5 is a flowchart illustrating a method according to still another embodiment of the present invention.

Another aspect of the present invention is a method of handling potentially misaligned speech segments. FIG. 5 provides a flowchart of exemplary steps of the method. Illustratively, the method includes at step 502 identifying at least one cluster, if any, of potentially misaligned speech segments within a plurality of sequentially arranged speech segments. Any cluster so identified contains at least one speech segment from among the plurality of sequentially arranged speech segments. Any identified cluster contains one or more of the sequentially arranged speech segments. A speech segment is included, however, if and only if the speech segment satisfies a predetermined filter text. Moreover, if two or more clusters are identified, each cluster will be bordered by at least one other speech segment from among the plurality of sequentially arranged speech segments, wherein the at least one other speech segment fails to satisfy the filtering test.

Whenever two or more clusters are identified, their respective speech segments are combined with one another, and with all speech segments that are between the two clusters and that fail to satisfy the filtering test, at step 504 to thereby generate an aggregated cluster, if the aggregated cluster satisfies a predetermined combining criterion. The method concludes at step 506.

Figure 6:
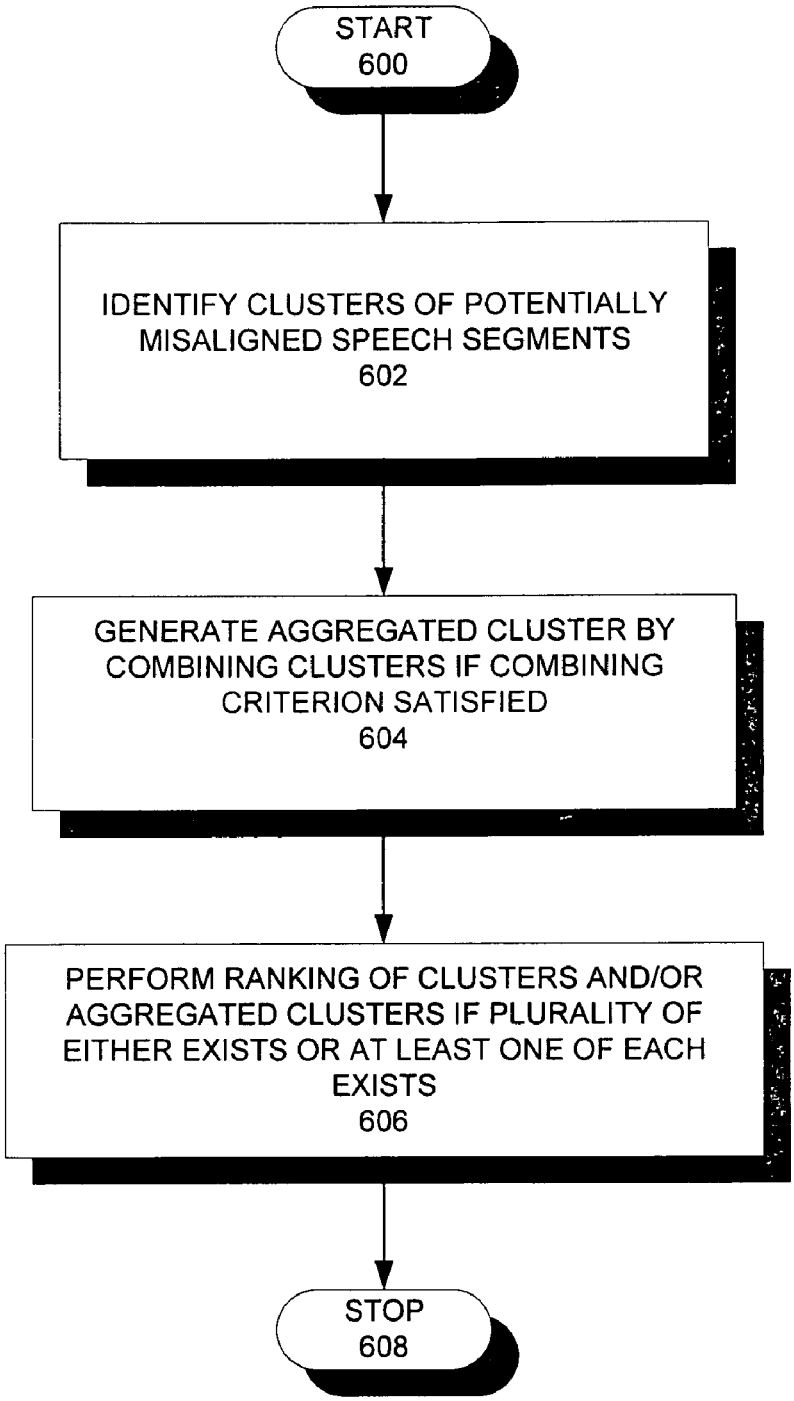
FIG. 6 is a flowchart illustrating a method according to yet another embodiment of the present invention.

FIG. 6 provides a flowchart exemplifying the steps of an additional method of handling potentially misaligned speech segments according to yet another embodiment of the present invention. At step 602, the method includes identifying one or more clusters, if any, of potentially misaligned speech segments within a plurality of sequentially arranged speech segments. The method further includes, at step 604, generating an aggregated cluster, if the aggregated cluster satisfies a predetermined combining criterion. Subsequently, at step 606, a ranking is performed under one of the following scenarios. Each cluster is relative to the others if at least two clusters are identified. Each aggregated cluster is ranked relative to other aggregated clusters if at least two aggregated clusters is generated. Each cluster and each aggregated cluster are relative to each other if at least one cluster is identified and at least one aggregated cluster is generated. The method concludes at step 608.

As noted already, the present invention can be realized in hardware, software, or a combination of hardware and software. The present invention can be realized in a centralized fashion in one computer system, or in a distributed fashion where different elements are spread across several interconnected computer systems. Any kind of computer system or other apparatus adapted for carrying out the methods described herein is suited. A typical combination of hardware and software can be a general purpose computer system with a computer program that, when being loaded and executed, controls the computer system such that it carries out the methods described herein.

The present invention also can be embedded in a computer program product, which comprises all the features enabling the implementation of the methods described herein, and which when loaded in a computer system is able to carry out these methods. Computer program in the present context means any expression, in any language, code or notation, of a set of instructions intended to cause a system having an information processing capability to perform a particular function either directly or after either or both of the following: a) conversion to another language, code or notation; b) reproduction in a different material form.

This invention can be embodied in other forms without departing from the spirit or essential attributes thereof. Accordingly, reference should be made to the following claims, rather than to the foregoing specification, as indicating the scope of the invention.

What is claimed is:

1. A method of identifying potentially misaligned speech segments from an ordered sequence of speech segments in order to create an accurate speech database for speech synthesis, the method comprising:

identifying a first cluster comprising at least one speech segment selected from the ordered sequence of speech segments if the at least one speech segment satisfies a predetermined filtering test for a misaligned segment;

identifying a second cluster comprising at least one different speech segment selected from the ordered sequence of speech segments if the at least one different speech segment satisfies the predetermined filtering test and if there is at least one intervening speech segment occupying a sequential position between the at least one speech segment and the at least one different speech segment, the intervening speech segment failing to satisfy the predetermined filtering test; and combining the first and second clusters and the at least one intervening speech segment to generate an aggregated cluster if the aggregated cluster satisfies a predetermined combining criterion, the aggregated cluster replacing the first and second clusters.

2. The method of claim 1, wherein the predetermined combining criterion reflects a likelihood that the at least one intervening speech segment is a misaligned speech segment.

3. The method of claim 1, wherein the predetermined combining criterion is based upon at least one of a breaking test condition and a sizing test condition, the breaking test condition setting a threshold number of intervening speech segments above which the clusters bracketing the intervening speech segments remain broken up into distinct clusters, the sizing test condition requiring a number of speech segments contained in an aggregated cluster to be greater than a predetermined number.

4. The method of claim 1, wherein each speech segment belonging to the ordered sequence has a corresponding confidence index indicating a likelihood that the speech segment to which the confidence index corresponds is a misaligned speech segment, and wherein the filtering test is based upon a comparison of each confidence index with a predetermined confidence threshold.

5. The method of claim 1, further comprising generating at least one additional aggregated cluster according to the same steps if the additional aggregated cluster satisfies the predetermined combining criterion, the aggregated cluster and the additional aggregated cluster being distinct from one another.

6. The method of claim 5, further comprising:

ranking each cluster relative to one another if at least two clusters are identified;

ranking each aggregate cluster relative to one another if at least two aggregate clusters are generated; and ranking each cluster and each aggregate cluster relative to each other if at least one cluster is identified and at least one aggregate cluster is generated.

7. The method of claim 6, wherein the ranking reflects a relative severity of speech misalignments.

8. A system for identifying potentially misaligned speech segments from an ordered sequence of speech segments in order to create an accurate speech database for speech synthesis, the system comprising:

a clustering module for identifying a first cluster comprising at least one speech segment selected from the ordered sequence of speech segments if the at least one speech segment satisfies a predetermined filtering test for a misaligned segment, and identifying a second cluster comprising at least one different speech segment selected from the ordered sequence of speech segments if the at least one different speech segment satisfies the predetermined filtering test and if there is at least one intervening speech segment occupying a sequential position between the at least one speech segment and the at least one different speech segment, the intervening speech segment failing to satisfy the predetermined filtering test; and a combining module for combining the first and second clusters and the at least one intervening consecutive speech segment to form an aggregated cluster if the aggregated cluster satisfies a predetermined combining criterion.

9. The system of claim 8, wherein the predetermined combining criterion reflects a likelihood that the at least one intervening speech segment is a misaligned speech segment.

10. The system of claim 8, wherein the predetermined combining criterion is based upon at least one of a breaking test condition and a sizing test condition, the breaking test condition setting a threshold number of intervening speech segments above which the clusters bracketing the intervening speech segments remain broken up into distinct clusters, the sizing test condition requiring a number of speech segments contained in an aggregated cluster to be greater than a predetermined number.

11. The system of claim 8, wherein each speech segment belonging to the ordered sequence has a corresponding confidence index indicating a likelihood that the speech segment to which the confidence index corresponds is a misaligned speech segment, and wherein the filtering test is based upon a comparison of each confidence index with a predetermined confidence threshold.

12. The system of claim 8, further comprising generating at least one additional aggregated cluster according to the same steps if the additional aggregated cluster satisfies the predetermined combining criterion, the aggregated cluster and the additional aggregated cluster being distinct from one another.

13. The system of claim 12, further comprising a ranking module for:

ranking each cluster relative to one another if at least two clusters are identified;

ranking each aggregate cluster relative to one another if at least two aggregate clusters are generated; and ranking each cluster and each aggregate cluster relative to each other if at least one cluster is identified and at least one aggregate cluster is generated.

14. The system of claim 13, wherein the ranking reflects a relative severity of speech misalignments.

15. A computer-readable storage medium for use in identifying potentially misaligned speech segments from an ordered sequence of speech segments in order to create an accurate speech database for speech synthesis, the computer-readable storage medium encoded with computer instructions for:

generating identifying a first cluster comprising at least one speech segment selected from the ordered sequence of speech segments if the at least one speech segment satisfies a predetermined filtering test for a misaligned segment;

identifying a second cluster comprising at least one different speech segment selected from the ordered sequence of speech segments if the at least one different speech segment satisfies the predetermined filtering test and if there is at least one intervening speech segment occupying a sequential position between the at least one speech segment and the at least one different speech segment, the intervening speech segment failing to satisfy the predetermined filtering test; and combining the first and second clusters and the at least one intervening speech segment to generate an aggregated cluster if the aggregated cluster satisfies a predetermined combining criterion, the aggregated cluster replacing the first and second clusters.

16. The computer-readable storage medium of claim 15, wherein the predetermined combining criterion reflects a likelihood that the at least one intervening speech segment is a misaligned speech segment.

17. The computer-readable storage medium of claim 15, wherein the predetermined combining criterion is based upon at least one of a breaking test condition and a sizing test condition, the breaking test condition setting a threshold number of intervening speech segments above which the clusters bracketing the intervening speech segments remain broken up into distinct clusters, the sizing test condition requiring a number of speech segments contained in an aggregated cluster to be greater than a predetermined number.

18. The computer-readable storage medium of claim 15, wherein each speech segment belonging to the ordered sequence has a corresponding confidence index indicating a likelihood that the speech segment to which the confidence index corresponds is a misaligned speech segment, and wherein the filtering test is based upon a comparison of each confidence index with a predetermined confidence threshold.

19. The computer-readable storage medium of claim 15, wherein the instructions contained therein further cause generation of at least one additional aggregated cluster if the additional aggregated cluster satisfies the predetermined combining criterion, the aggregated cluster and the additional aggregated cluster being distinct from one another.

20. The computer-readable storage medium of claim 19, further encoded with computer instructions for:

ranking each cluster relative to one another if at least two clusters are identified;

ranking each aggregate cluster relative to one another if at least two aggregate clusters are generated; and ranking each cluster and each aggregate cluster relative to each other if at least one cluster is identified and at least one aggregate cluster is generated.

21. The computer-readable storage medium of claim 20, wherein the ranking reflects a relative severity of speech misalignments.

* * * * *